US010288230B2

(12) United States Patent
Zhao et al.

(10) Patent No.: US 10,288,230 B2
(45) Date of Patent: May 14, 2019

(54) LAMP CAP WITH BUILD-IN SWITCH AND LED TUBE

(71) Applicant: CH LIGHTING CO., LTD., Shaoxing, Zhejiang Province (CN)

(72) Inventors: Guosong Zhao, Shaoxing (CN); Jianhua Su, Shaoxing (CN)

(73) Assignee: CH LIGHTING CO., LTD., Shaoxing (CN)

( * ) Notice: Subject to any disclaimer, the term of this patent is extended or adjusted under 35 U.S.C. 154(b) by 76 days.

(21) Appl. No.: 15/282,360

(22) Filed: Sep. 30, 2016

(65) Prior Publication Data

US 2018/0038556 A1 Feb. 8, 2018

(30) Foreign Application Priority Data

Aug. 28, 2016 (CN) ..... 2016 1 0738655

(51) Int. Cl.

| | |
|---|---|
| ***F21K 9/272*** | (2016.01) |
| ***F21V 23/04*** | (2006.01) |
| ***F21V 25/04*** | (2006.01) |
| *F21K 9/275* | (2016.01) |
| *F21K 9/278* | (2016.01) |
| *F21Y 103/10* | (2016.01) |
| *F21V 19/00* | (2006.01) |

(52) U.S. Cl.

CPC ..... *F21K 9/272* (2016.08); *F21V 23/04* (2013.01); *F21V 25/04* (2013.01); *F21K 9/275* (2016.08); *F21K 9/278* (2016.08); *F21V 19/0005* (2013.01); *F21Y 2103/10* (2016.08)

(58) Field of Classification Search

CPC ..... F21K 9/272; F21V 23/04

See application file for complete search history.

(56) References Cited

U.S. PATENT DOCUMENTS

| | | | | |
|---|---|---|---|---|
| 9,629,216 | B2 * | 4/2017 | Jiang | F21V 3/061 |
| 2013/0162417 | A1 * | 6/2013 | Chu | H03K 17/962 340/407.2 |

* cited by examiner

*Primary Examiner* — Joseph L Williams

(74) *Attorney, Agent, or Firm* — Jiwen Chen

(57) ABSTRACT

The invention discloses a built-in switch cap, including a cylinder body, one end of which is open for setting a tube, the other end is closed and is provided with pins and connected with a drive power. There is a micro-switch installed in the cap to control the ON/OFF of the drive power; a flexible button is provided to press the above micro switch, the press button is bulging from on the closed side of the cylinder body. The invention discloses a LED tube, which at least has one cap. The invention uses the micro switch installed in the lamp cap, pressing the button on the cap when touching the switch, the power source supplies power, increasing the safety of products. The cap also can directly replace the existing cap, with a strong commonality.

5 Claims, 3 Drawing Sheets

LAMP CAP WITH BUILD-IN SWITCH AND LED TUBE

The present application claims the priority benefit of Chinese Application No. 201610738655.8, filed Aug. 8, 2016, which is hereby incorporated by reference.

TECHNICAL FIELD

The present invention relates to the field of LED (light-emitting diode) lighting, specifically involving a built-in switch cap and LED tube.

BACKGROUND TECHNOLOGY

LED tube is also known as clean tube and fluorescent tube, with the LED as an illuminant body. A LED using light emitting diode as its light source, which has higher light efficiency, more energy saving, longer lifetime and environment-friendly, has become the most ideal product to replace fluorescent lamp. A LED tube has the same exterior dimension and tube diameter as fluorescent tube, such as T5 tubes, T8 tubes and T10 tubes, and so on.

A LED tube has a very simple way of installation including removing the original tube, then inserting the pin cap on both ends of the LED tube into the lamp holder, directly adding the AC to two ends of the LED tube.

LED T8 tubes are widely used, mainly for indoor lightening. The classification of LED T8 tube can be divided into 0.6 meters, 0.9 meters, 1.2 meters and 1.5 meters according to its length. Different length means different power. The longer the length, the more the chips, and power will increase; according to the shape of tube, the tubes can be divided into circular and elliptical tubes and so on.

In the current lamps, the controlling switch is mostly designed on the socket or a switch box is installed separately on the wall to control the on/off of the tube. If the switch is open, there exists some risk of inserting the LED tube to the pin cap immediately.

THE SUMMARY OF THE INVENTION

Aiming at the problems existing in the present technology, present invention provides a built-in switch cap and LED tube. The micro switch installed in the cap will be pressed when tube is inserted to the lamp holder, then the power source starts to work and light up the LED tube. It can replace existing lamp cap with safety and better commonality.

A built-in switch lighting cap, comprising a cylinder body having one end open for assembling tube, and the other end closed with pins which electrically connecting to a power source of the lamp, characterized in that a micro switch is installed within the lighting cap for controlling on or off of power source, and an active press-button was set, raised at the closed end of lamp cap, to trigger the micro switch.

The present invention improves from existing lamp cap and uses micro switch technology which enables lamp to connect directly to certain voltage power. With advantages of its small volume, pleasing design and cheap cost, such cap could be widely applied with convenience, and enables connection with power source by micro switch.

When inserting such a cap into lamp base, press-button will be pressed inside by resistance, triggering the micro switch, and enabling pins electrically connected with power driver.

The present invention could use integrated lamp cap, or combination cap. As for preferred option, the other end of the cylinder body is sealed by end closure wherein pins are inserted, and on the end closure, a through hole is installed for cooperation of the extrusion of the press-button. Therefore, the lamp cap, formed by the cylinder body and the end closure, makes whole tube assembly simple. The end closure could be bonded or bolted to be fixed inside of the cylinder body. The press-button extends outwards through the through hole, and will be pressed inwards when receiving resistance from the lamp holder.

Preferably, a circle edge is set onto an inside-wall of the cylinder body, the end closure is inserted in to the cylinder body and engages the circle edge, in order to control assembly position of the end closure. Besides, the circle edge sets bolt hole for fixing the end closure, therefore the end closure and the cylinder body are fixed by bolts.

Preferably, a limiting board is installed on the press-button for preventing the press-button from slipping from the cylinder body, the limiting board is slightly larger than the through hole, with one surface of the limiting board has bumping points to trigger the micro switch, and the surface of the limiting board also has a steering bar.

Preferably, the two micro switches are paralleled and reversely arranged, corresponding to the two bumping points.

The "reversely arranged" means that the pressure part on the micro switch faces different directions, as a level-roller switch, levels on two micro switches raise alternately, so is the two bumping points. The present invention controls electrically-connecting between two pins and power source by two micro switches at same time.

Preferably, a support board is installed within the micro switch and the steering hole for steering bar is located inside of the cylinder body, which guides the press-button's action.

Preferably, a spring is installed onto the steering bar and engages against the position limiting board and the support board. Therefore, when the lamp cap is released from the lamp holder, the press-button will be restored by the spring, releases the micro switch, and cuts off electrical connection between the pins and the power source.

Preferably, the support board is the printed circuit board which electrically connects to the pins, power source and micro switch.

Preferably, the press button is set between two pins.

The present invention discloses a LED (light emitting diode) tube, where a lamp cap is set onto at least one end of the LED tube. Moreover, such lamp cap could be set onto both ends of LED (light emitting diode) tube.

The present invention adopts micro switch technology to achieve highly precise control, with advantage on its small volume, pleasing design and cheap cost, such cap could be widely applied with convenience, and enables driver powered by micro switch.

DETAILED DESCRIPTION OF THE EMBODIMENTS OF THE INVENTION

Figure 1:
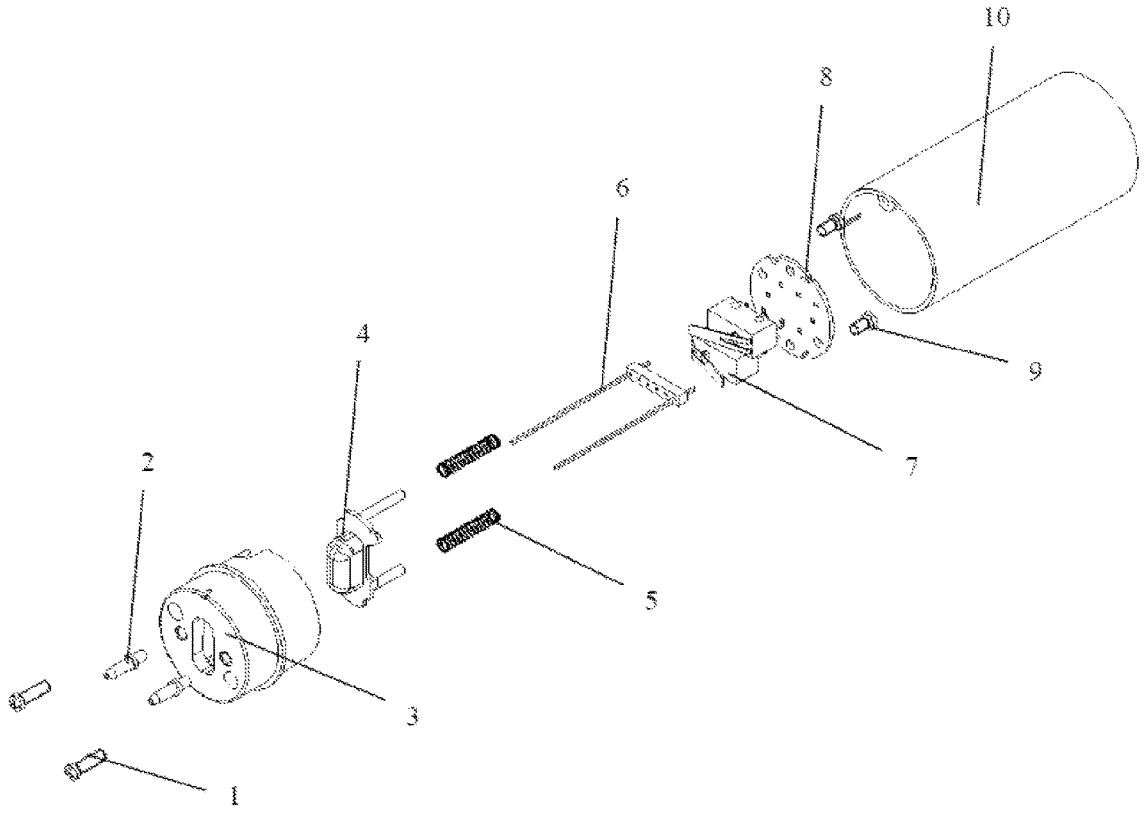
FIG. 1 is the exploded view of the present invention
Figure 2:
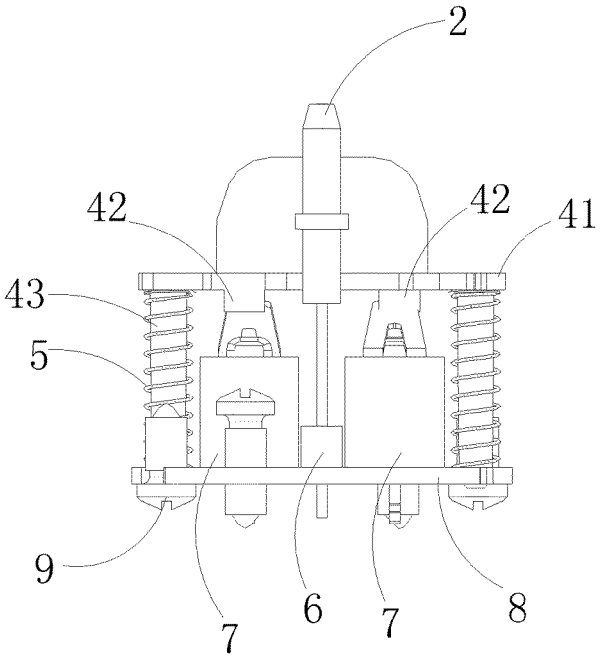
FIG. 2 is the inside structure diagram of the lamp cap
Figure 3:
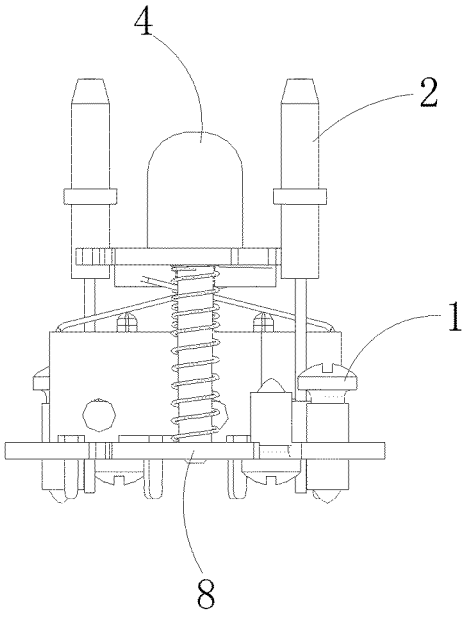
FIG. 3 is another inside structure diagram of the lamp cap
Figure 4:
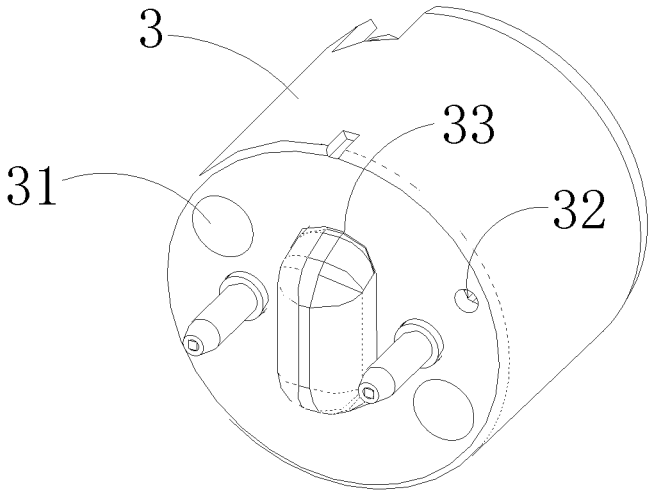
FIG. 4 is the structure diagram of the end closure.
Figure 5:
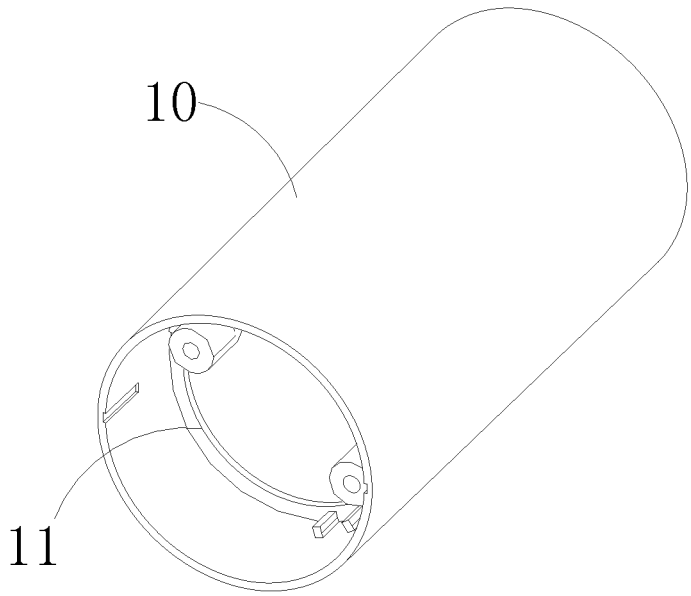
FIG. 5 is the structure diagram of the cylinder.

The lamp cap as shown in FIGS. 1~5, including an end closure 3, a cylinder body 10, pins 2, a press button 4, a spring 5, a row pin 6, a micro switch 7 and a printed circuit board 8, a pin 6, a spring 5, a micro switch 7 and a printed circuit board 8 are all set inside of the lamp cap, wherein the printed circuit board 8 and the micro switch 7, the row pin 6, and the pin 2 are electrically connected to the power source (not shown) of the lamp.

The two ends of the cylinder body 10 are open, wherein one end is used to assembly the tube, the end closure 3 is inserted into the other end of the cylinder body 10 to sealingly close that end. The inner wall of the cylinder body 10 is provided with the rim 11 for position limiting purposes, the end closure 3 is inserted in the cylinder 10 and engages against the rim 11, which can control the position of the end closure. The rim 11 is provided with bolt holes to fix the end closure 3. After the end closure 3 is assembled into the cylinder body 10, using the bolt 1 installed within the bolt assembly hole 31 such that the bolt 1 passes through the circuit board 8 and screws into the bolt hole on the edge of the ring to complete the fixation of the end closure.

The end closure 3 has an air vent 32 and a through hole 33 for the extrusion of the raised press button 4, two pin 2 also sets on the end closure 3 and connects to the printed circuit board 8 though the row pin 6, the through hole 33 is located between the two pins 2. The printed circuit board 8 is fixed inside of the end closure 3 through the screw 9.

The position limiting board 41 is located on the press button 4 and the board prevents the press button from slippery from the through hole 33. The position limiting board a bit bigger in size than the through hole, one surface of the position limiting board has bumping points 42 and a steering bar 43. The bumping points 42 are used to trigger the micro switch 7, when the lamp is inserted into the lamp holder; the press button 4 is pressed back by resistance, which triggers the micro switch 8, which enables the electrical connection between the pin 2 and the power source. The printed circuit board 8 has steering holes; the press button 4 is guided to work through the cooperation between the steering bar 43 and the steering hole.

In this practical embodiment, the two micro switches 7 are both parallelly and reversely arranged, correspond to the bumping points 42 alternately, in order to control electrical connecting between the two pins 2 and the power source at same time. In addition, two steering bar 43 respectively sets on two sides of the press-button 4 to keeps balance of pressure on the press button 4.

The spring 5 is sleeved onto the steering bar 43, the two ends of the spring 5 respectively engage against the position liming board 41 and the printed circuit board 8. In other words, once the lamp cap is released from the lamp holder, press button 4 will be restored by action of the spring 5, causing the bumping points 42 to release its action on the micro switch 7, and to cut off electrical connection between the pins 2 and the power source.

In another embodiment, both ends of the LED tube are arranged with the above structured cap. When the LED tube inserted in the socket, the press button 4 contracts inwardly after receiving resistance and engages with the micro switch 8 to connect the electrical circuit between the power source and the pins 2, so that the LED tube's electrical circuit is completed. When the LED tube is removed from the lamp-socket, the press button 4 reset to its original position, which relieves its action to the micro-switch 7, disconnecting the electrical circuit connection between the power source and the pin 2.

The above description is only for the better implementation of the invention, the invention is not used to limit, all within the spirit and principle of the invention, any modification made by equivalent replacement, improvement, should be included in the scope of protection of the invention.

The invention claimed is:

1. A lamp cap with a build-in switch, compromising a cylinder body, having one end of the cylinder body being open for installing a lamp tube, and another end of the cylinder body being closed with pins which electrically connecting to a power source of the lamp, characterized in that, within the lamp cap, a micro switch is installed for controlling on or off of the power source, and a movable press button is installed to trigger the micro switch, the press button being raised from the closed end of the lamp cap, wherein a position limiting board is provided on the press-button and the board prevents the press button from slipping from the cylinder body, with one surface of the limiting board has bumping points to trigger the micro switch, and the surface of the limiting board also has a steering bar, characterized in that the lamp cap is sealed by an end closure, pins are inserted on the end closure, and a through hole is provided on the end closure to cooperate with the raised press-button.

2. The lamp cap according to claim 1, characterized in that a circle edge is set onto an inner wall of the cylinder body, the end closure is inserted in the cylinder body and engages with the circular edge, and a bolt hole is located on the circular edge for fixing the end closure.

3. A lamp cap with a build-in switch, compromising a cylinder body, having one end of the cylinder body being open for installing a lamp tube, and another end of the cylinder body being closed with pins which electrically connecting to a power source of the lamp, characterized in that, within the lamp cap, a micro switch is installed for controlling on or off of the power source, and a movable press button is installed to trigger the micro switch, the press button being raised from the closed end of the lamp cap, wherein a position limiting board is provided on the press-button and the board prevents the press button from slipping from the cylinder body, with one surface of the limiting board has bumping points to trigger the micro switch, and the surface of the limiting board also has a steering bar, characterized in that a support board is provided within the cylinder body, the micro switch is installed on the support board, and a steering hole is provided in the support board to cooperate with the steering bar, and characterized further in that the support board is the printed circuit board which electrically connects the pins, the power source and the micro switch.

4. A lamp cap with a build-in switch, compromising a cylinder body, having one end of the cylinder body being open for installing a lamp tube, and another end of the cylinder body being closed with pins which electrically connecting to a power source of the lamp, characterized in that, within the lamp cap, a micro switch is installed for controlling on or off of the power source, and a movable press button is installed to trigger the micro switch, the press button being raised from the closed end of the lamp cap, wherein a position limiting board is provided on the press-button and the board prevents the press button from slipping from the cylinder body, with one surface of the limiting board has bumping points to trigger the micro switch, and the surface of the limiting board also has a steering bar, characterized in that the press button is located between two pins.

5. An LED tube characterized in that the lamp cap according to claim 1 is connected with the LED tube.

* * * * *